US006264585B1

(12) United States Patent
Beauchamp

(10) Patent No.: US 6,264,585 B1
(45) Date of Patent: Jul. 24, 2001

(54) DIRECT DRIVE EXERCISING APPARATUS

(76) Inventor: Claude Beauchamp, 128 deNantes, Ste-Julie P.Q (CA)

( * ) Notice: Subject to any disclaimer, the term of this patent is extended or adjusted under 35 U.S.C. 154(b) by 0 days.

(21) Appl. No.: 09/078,201

(22) Filed: May 14, 1998

(51) Int. Cl.[7] ..... A63B 21/062

(52) U.S. Cl. ..... 482/72; 482/97; 482/98; 482/137

(58) Field of Search ..... 482/97, 98, 100, 482/101, 72, 135, 137, 136, 138, 134, 133

(56) References Cited

U.S. PATENT DOCUMENTS

| | | | | |
|---|---|---|---|---|
| 3,917,262 | * | 11/1975 | Salkeld | 482/98 |
| 4,336,934 | * | 6/1982 | Hanagan et al. | 482/97 |
| 4,354,675 | * | 10/1982 | Barclay et al. | 482/98 |
| 4,614,338 | * | 9/1986 | Castillo | 482/98 |
| 4,765,611 | * | 8/1988 | MacMillan | 482/98 |
| 4,838,548 | * | 6/1989 | Maag | 482/100 |
| 4,883,270 | * | 11/1989 | Maag | 482/97 |
| 4,917,379 | * | 4/1990 | Maag | 482/97 |
| 5,100,128 | * | 3/1992 | Mabry et al. | 482/98 |
| 5,250,013 | * | 10/1993 | Brangi | 482/98 |
| 5,304,107 | * | 4/1994 | Jones | 482/98 |
| 5,749,813 | * | 5/1998 | Domzalski | 482/97 |

FOREIGN PATENT DOCUMENTS

| | | | | |
|---|---|---|---|---|
| 244070 | * | 3/1987 | (DD) | 482/97 |
| 287657 | * | 3/1991 | (DD) | 482/97 |

OTHER PUBLICATIONS

Schwarzenegger, Arnold, Encyclopedia of Modern Bodybuilding, Simon & Schuster, Inc., NY, p. 495, 1985.*

* cited by examiner

*Primary Examiner*—Mickey Yu
*Assistant Examiner*—Victor Hwang
(74) *Attorney, Agent, or Firm*—Swabey Ogilvy Renault; Guy Houle

(57) ABSTRACT

A direct drive exercising apparatus is comprised of three main linkages adapted to displace a predetermined weight stack upon a user person performing an exercise. The linkages are comprised of weight stack connecting members pivotally connected at a first end to a carrier member on which the weight stacks are disposed, and pivotally connected at an opposed end to an attachment frame. Force transmitting members are pivotally connected to the attachment frame. A user engaging member is secured to the force transmitting members to impart pivotal movement thereto. Link members are pivotally connected at one end to the stack connecting members intermediate the first and second opposed ends. The link members are also connected at an opposed end thereof to the force transmitting members. The link members apply a force on the stack connecting members to cause pivotal displacement thereof to lift a stack of selected ones of weight elements attached to the carrier member when the user exerts an exercising force against a user engaging element of the force transmitting members.

7 Claims, 12 Drawing Sheets

17'
17
83'
83
84
85
84'
82'
82
86'
29
31
22
24
19
16
87
13
13
20'
11

DIRECT DRIVE EXERCISING APPARATUS

TECHNICAL FIELD

The present invention relates to a direct drive exercising apparatus consisting of few link members interconnected together and having few moving parts and providing a substantially constant load throughout the entire range of motion of the exercising apparatus.

BACKGROUND ART

Various exercising apparatus are known and including apparatus which do not utilize pulleys, belts, cables and cams. An advantage of such systems is that they require very little maintenance, they have been break-downs and are long lasting. Examples of such apparatus are found in U.S. Pat. Nos. 3,116,062; 5,554,090; 5,304,107; and 3,917,262. However, there are problems associated with these apparatus and some of these problems comprise irregular resistance or load provided through the connections between the weight stack and the user element throughout a range of exercising motion by a user. Many of these devices also do not provide a "feeling" to the user that he is lifting or pushing weights. Another problem with some of these devices is that they do not provide a high level of safety due to interconnections being disposed too close to the hands or arms or legs of the user person. A still further problem is that some of these devices do not provide easy entry and exit access to the user as well as minimal adjustment requirements to adapt the machine to a user's stature. A still further disadvantage of some of these machines is that due to their mechanical complexities it is sometimes difficult for the user to ascertain how to use the machine.

SUMMARY OF INVENTION

It is therefore a feature of the present invention to provide a direct drive exercising apparatus which substantially overcomes the above-mentioned disadvantages of the prior art.

Another feature of the present invention is to provide a direct drive exercising apparatus which is simple in construction, simple to use, utilizes few moving parts, is reliable and long lasting, requires little maintenance and ensures smooth operation throughout an entire range of motion while providing a substantially constant load.

Another feature of the present invention is to provide a direct drive exercising apparatus which delivers to the user a feeling simulating weight lifting all within the safety of the machine.

According to a broad aspect of the present invention there is provided a direct drive exercising apparatus which comprises a support frame for supporting the apparatus on a floor surface. An attachment frame is immovably secured to the support frame and projects thereabove. A user exercising station is disposed relative to the attachment frame. A weight stack is slidingly retained on an elongated guide restraining means. The guide restraining means is fixedly and immovably mounted at a lower end thereof. The weight stack has a plurality of weight elements of predetermined weight. Each weight element has means to connect same at a desired location along an elongated carrier member. A connector secures a weight element at the desired location. A weight stack connecting means is pivotally connected to the carrier member and pivotally connected at an end to an intermediate link means. The intermediate link means is immovably secured to a force transmitting means which is pivotally connected to the attachment frame. A user engaging member is secured to the force transmitting means to impart pivotal movement thereto. The intermediate link means applies an upward force on the stack connecting means to cause pivotal displacement of the stack connecting means and to lift a stack of selected ones of the weight elements in a guided manner along the elongated guide restraining means.

BRIEF DESCRIPTION OF DRAWINGS

A preferred embodiment of the present invention will now be described with reference to the accompanying drawings in which.

DESCRIPTION OF PREFERRED EMBODIMENTS

Figure 1A:
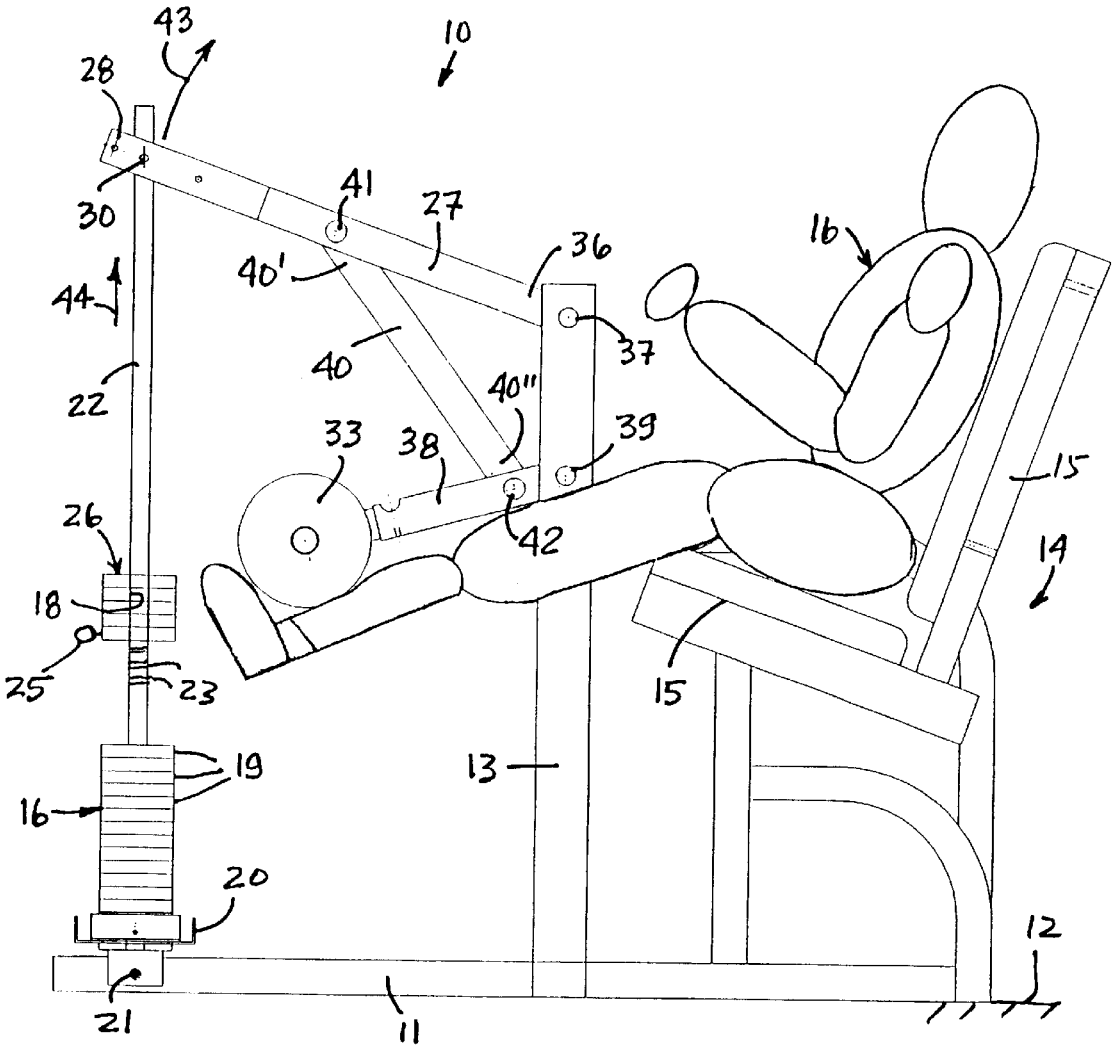
FIG. 1A is a side view, partly fragmented, of a direct drive leg extension exercising apparatus constructed in accordance with the present invention.
Figure 1B:
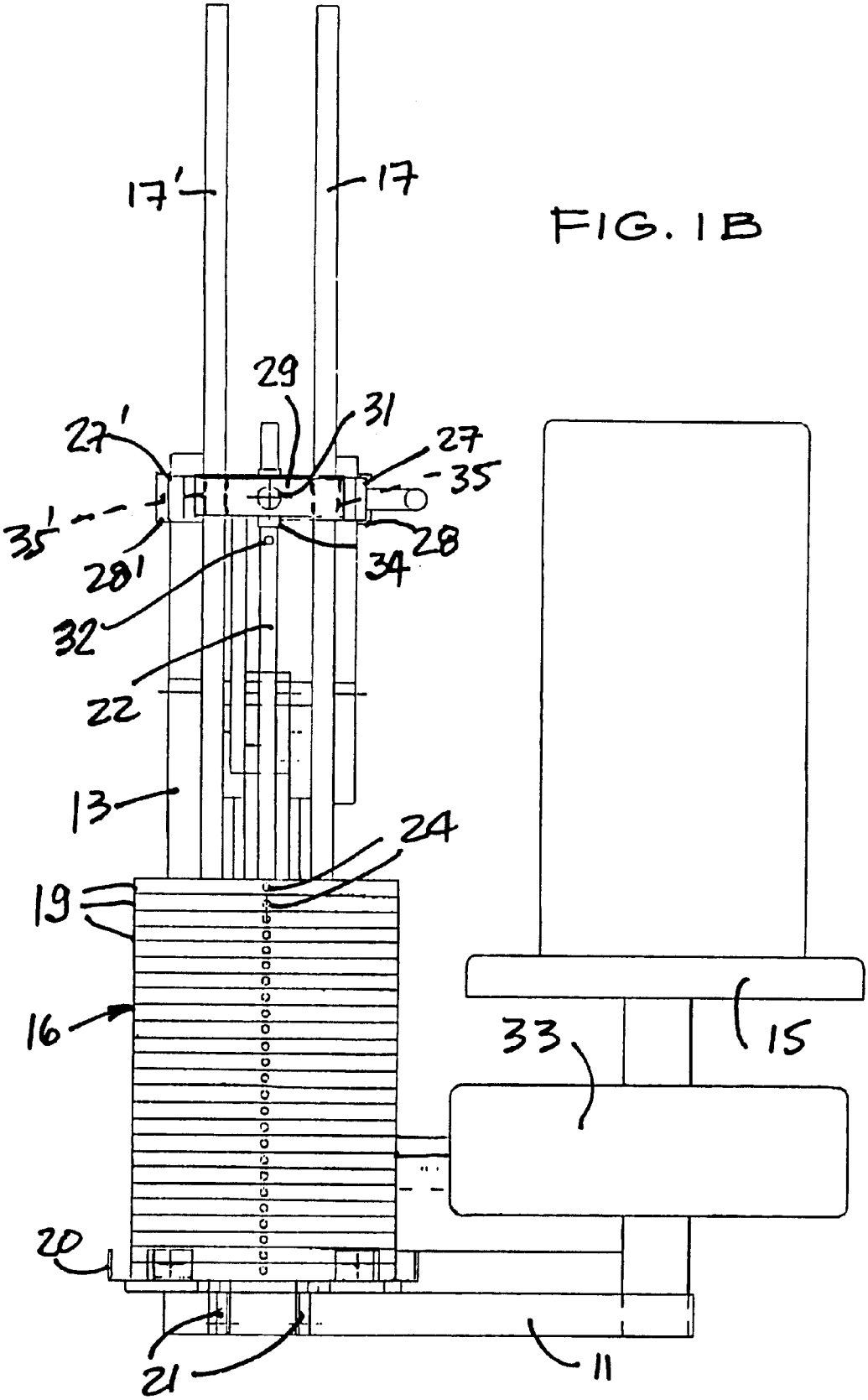
FIG. 1B is an end view of the apparatus of FIG. 1A.

Referring now to the drawings, and more particularly to FIGS. 1A and 1B, there is shown generally at 10 an example of a direct drive exercising apparatus constructed in accordance with the present invention. The apparatus as hereinshown provides a leg extension exercise. A support frame 11 is provided for supporting the apparatus on a floor surface 12. An attachment frame 13 is immovably secured to the support frame 11 and projects thereabove, as hereinshown. A user exercising station 14 is disposed to one side of the attachment frame and is provided with a seat structure 15 on which the user person 16' sits to perform the leg extension exercise, as herein illustrated.

With particular reference to FIG. 1B, it can be seen that a weight stack 16 is slidingly retained by a pivotal elongated guide restraining means which consists of a pair of straight, substantially parallel, guide rods 17 and 17' extending through holes 18 provided in each of the weight elements 19. The weight elements are supported at a lower end on a support harness 20 which is pivotally connected by pivot pin 21 to the support frame 11. The guide rods 17 are connected to the harness 20. An elongated carrier rod 22 is provided with a series of spaced-apart holes 23 in a lower section thereof whereby to connect thereto a predetermined stack of weight elements 19. Each of the weight elements 19 is also provided with a transverse hole 24 whereby to receive a connector pin 25 therein and through an aligned one of the holes 23 provided in the carrier rod 22 whereby a stack of a predetermined number of weight elements 19 may be connected to the carrier rod 22. Such a stack is illustrated at 26 in FIG. 1A.

Weight stack connecting means herein provided in the form of a pair of straight parallel connecting arms 27 and 27' are pivotally connected at a first end 28 and 28' to a connector block 29 which is pivotally connected by pivot connection 30 between the arms 27 and 27'. The connector block 29 is secured to the carrier rod 22 by a connector pin element 31 and into a selected one of a plurality of holes 32 provided in a top section of the carrier rod 22 so as to adjust the position of a user engaging member 33 to adapt the machine to the comfort and stature of a user person 16. As shown in FIG. 1B, the carrier rod 22 extends through a channel member 34 disposed centrally in the connecting block 29. The elongated guide restraining rods 17 and 17' also extend through guide bores 35 and 35' also extending through the connecting block 29.

It is to be pointed out that all of the side views only show the rear guide rod as well as the carrier rod but both guide rods can be seen on the end views and this will not be repeated during the description of the various examples of the preferred embodiment.

As shown in FIG. 1A, the opposed ends 36 of the parallel connecting arms 27 and 27' are each pivotally connected by pivot connection 37 to a top end of the attachment frame 13. The user engaging member 33 is hereinshown as a large cylindrical pad, or two such pads, connected on opposed sides of a pair of parallel support arms 38 (only one shown herein) which constitutes a force transmitting means. These parallel support arms 38 are pivotally connected to the attachment frame 13 by a further pivot connection 39 and disposed at a predetermined position below the pivot connection 37 at its top end.

Link means in the form of a pair of link arms 40 are pivotally connected at a top end 40' by a further pivot connection 41 disposed intermediate the opposed ends of the stack connecting arms 27 and 27'. There are two link arms 40, and each is associated with a respective one of the connecting arms 27 and the force transmitting arms 38. The lower end 40" of the link arm 40 is pivotally connected by pivot connection 42 to the force transmitting arm 38 at a location near the pivot connection 39. Accordingly, the pair of stack connecting arms 27, the pair of link arms 40 and the pair of force transmitting arms 38 are all interconnected to form a parallelogram-like structure and their pivot connections are selected whereby to provide for a smooth exercising operation when the user person 16' applies a lifting force on the foot engaging pads 33. This lifting force causes the stack connecting arm to move about its pivot connection 37 in the direction of arrow 43 providing a lifting force on the carrier rod 22 in the direction of arrow 44 whereby to lift the selected stack 26 from the weight stack 16. FIG. 1A shows the user engaging pad 33 in an engaged lifted position. It is also pointed out that during the full displacement of the user engaging pad 33, a constant load resistance is provided to the user throughout the entire range of motion by the particular manner in which the arms are interconnected to the weight stack carrier rod 22.

Figure 2A:
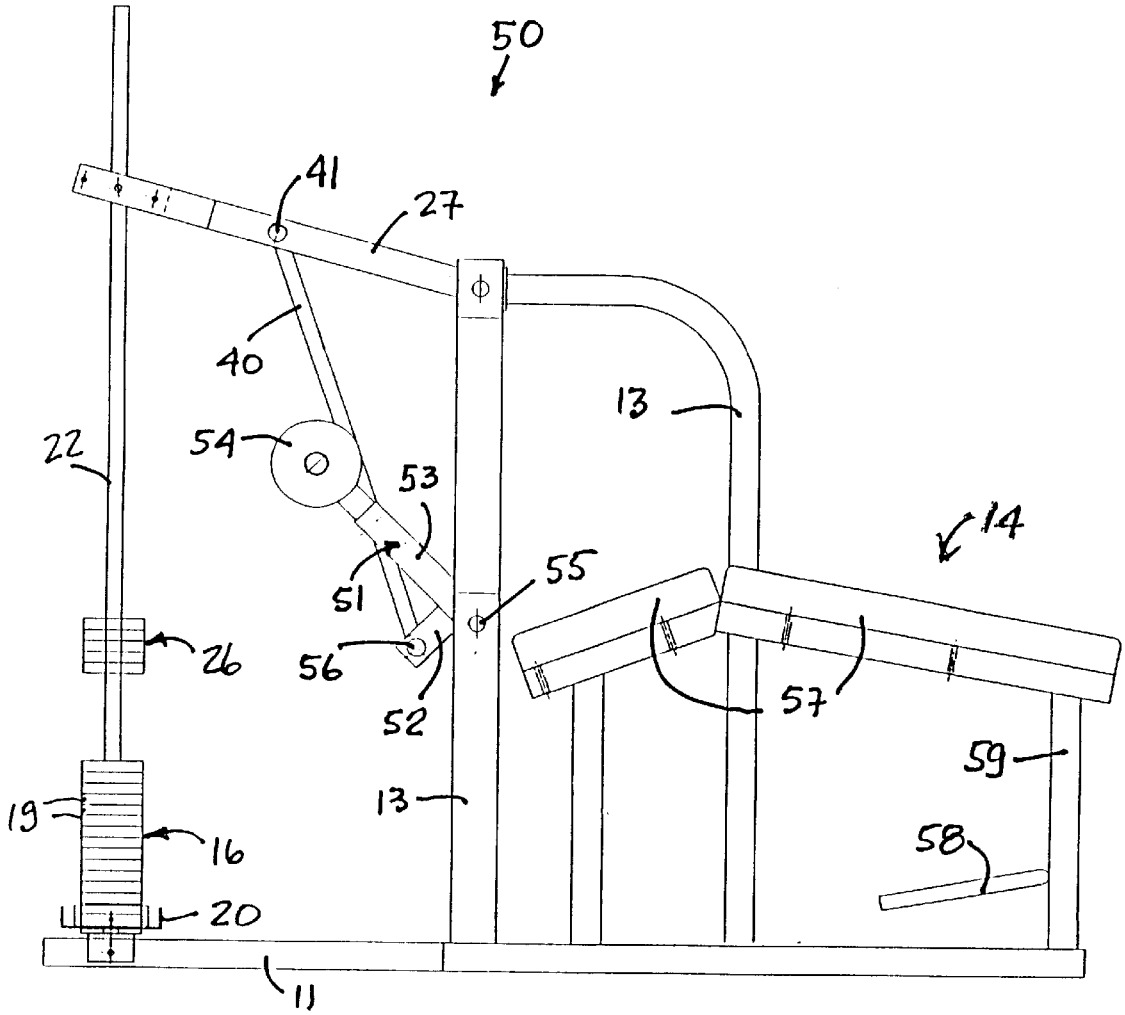
FIG. 2A is a side view of a direct drive leg curl exercising apparatus constructed in accordance with the present invention.
Figure 2B:
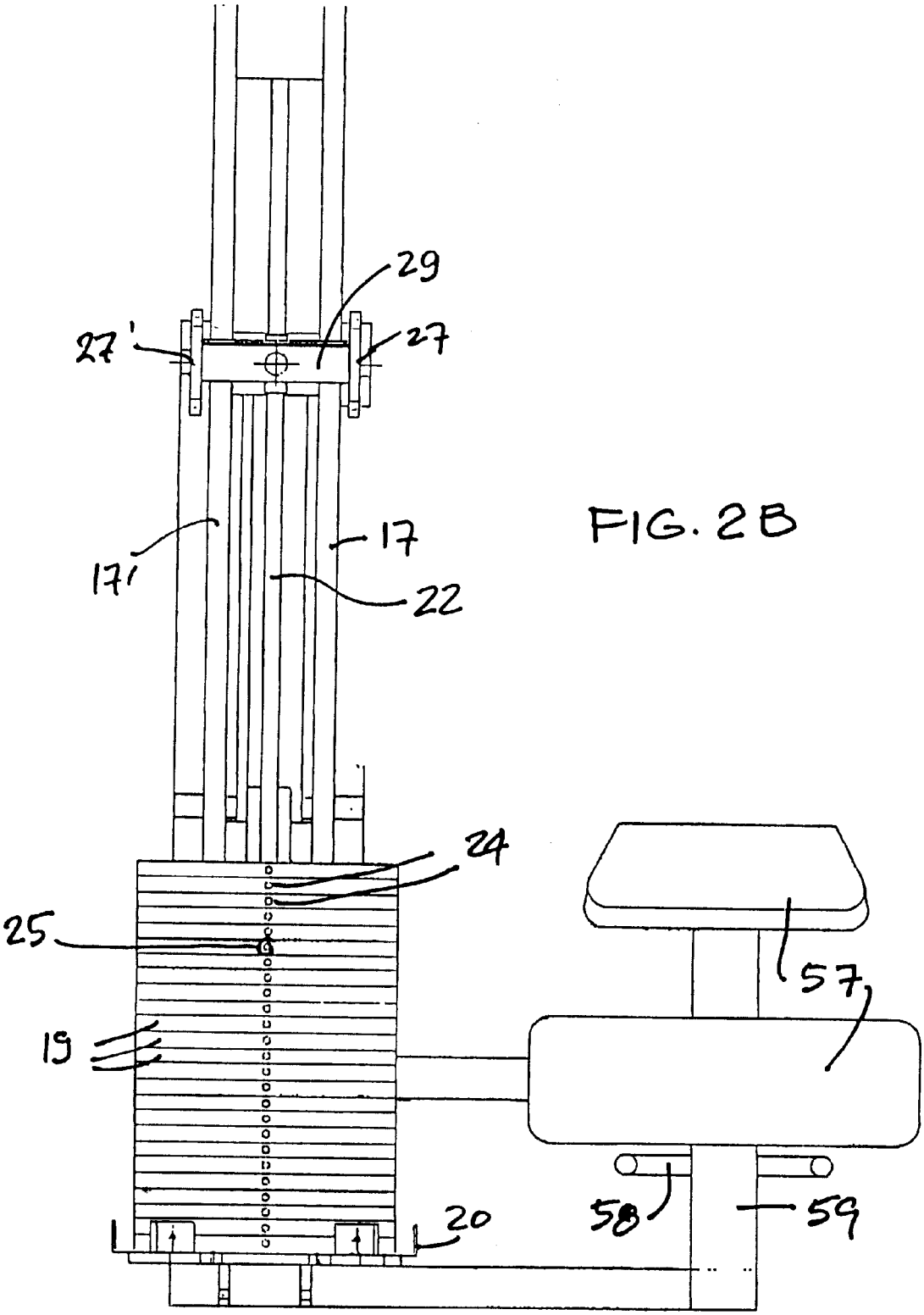
FIG. 2B is a front view of FIG. 2A.
Figure 2C:
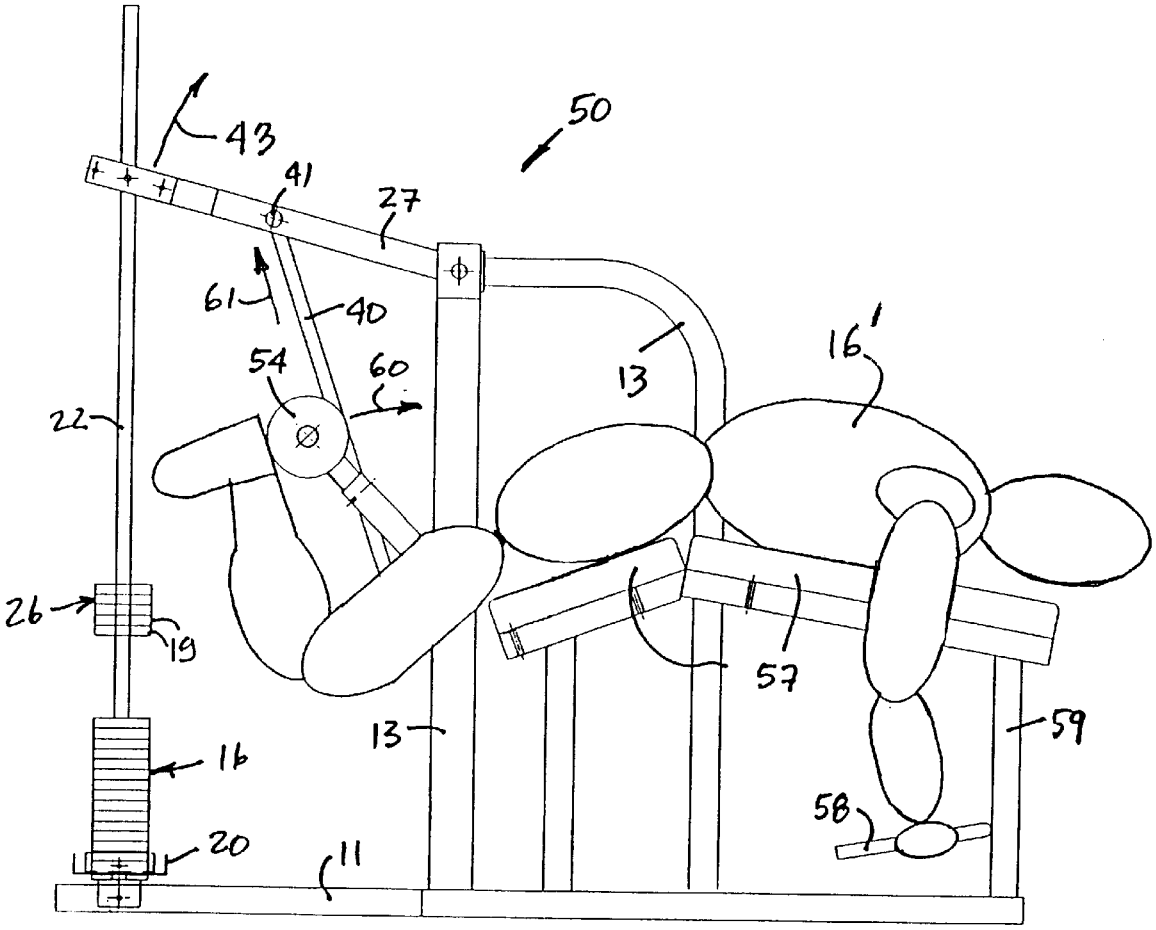
FIG. 2C is a side view similar to FIG. 2A but showing the position of a user person on the direct drive leg curl exercising apparatus.

Referring now to FIGS. 2A to 2C, there is shown another example of a direct drive exercising apparatus constructed in accordance with the present invention. As hereinshown generally at 50, the apparatus is a leg curl apparatus and it is utilized by a user person 16' as illustrated in FIG. 2C. As hereinshown the force transmitting means is constituted by a pair of parallel L-shaped support arms 51 instead of the straight parallel support arms 38 of FIG. 1A. Each of the L-shaped support arms 51, only one of them being shown herein, has a first leg 52 and a second leg 53 interconnected therewith and extending at right angles to the first leg and upwardly thereof. A user engaging member 54, also hereinshown as a pair of cylindrical pads, is secured to a top end of the second leg 53. Each L-shaped support arm 51 is attached to the frame 13 at a bottom end of the second arm 53 by a pivot connection 55.

The link arm 40 is hingedly connected to the free end of the first leg 52 by a pivot connection 56. Similar to FIG. 1A it is also pivotally connected at a top end intermediate the ends of a respective one of the stack connecting arms 27 and 27' by a pivot connection 41, as previously described. The L-shaped support arms 51, the link arms 52 and 40 and the stack connecting arms 27 are also connected to form a parallelogram-like linkage.

As hereinshown the user exercising station 14 is herein provided with a bench 57 which permits the user person 16' to lie flat on his stomach, as shown in FIG. 2C, and to grasp a pair of handlebars 58 secured to the forward legs 59 of the bench 57 so as to brace himself while effecting a leg curl exercise. During a leg curl exercise, the user person pushes on the cushions 54 in the direction of arrow 60 and this causes the link arms 52 and 40 to be displaced upwardly in the direction of arrow 61 which again causes the stack connecting arms 27 to pull the carrier rod 22 upwardly to lift the predetermined stack 26. FIG. 2C illustrates the user person performing this exercise with the stack 26 having been lifted a predetermined distance from the main stack 16. During this motion the carrier rod 22 as well as the guide rods 17 and 17' will be displaced on their pivot support harness 20 to which they are connected and a constant load is applied to the cushions 54.

Figure 3A:
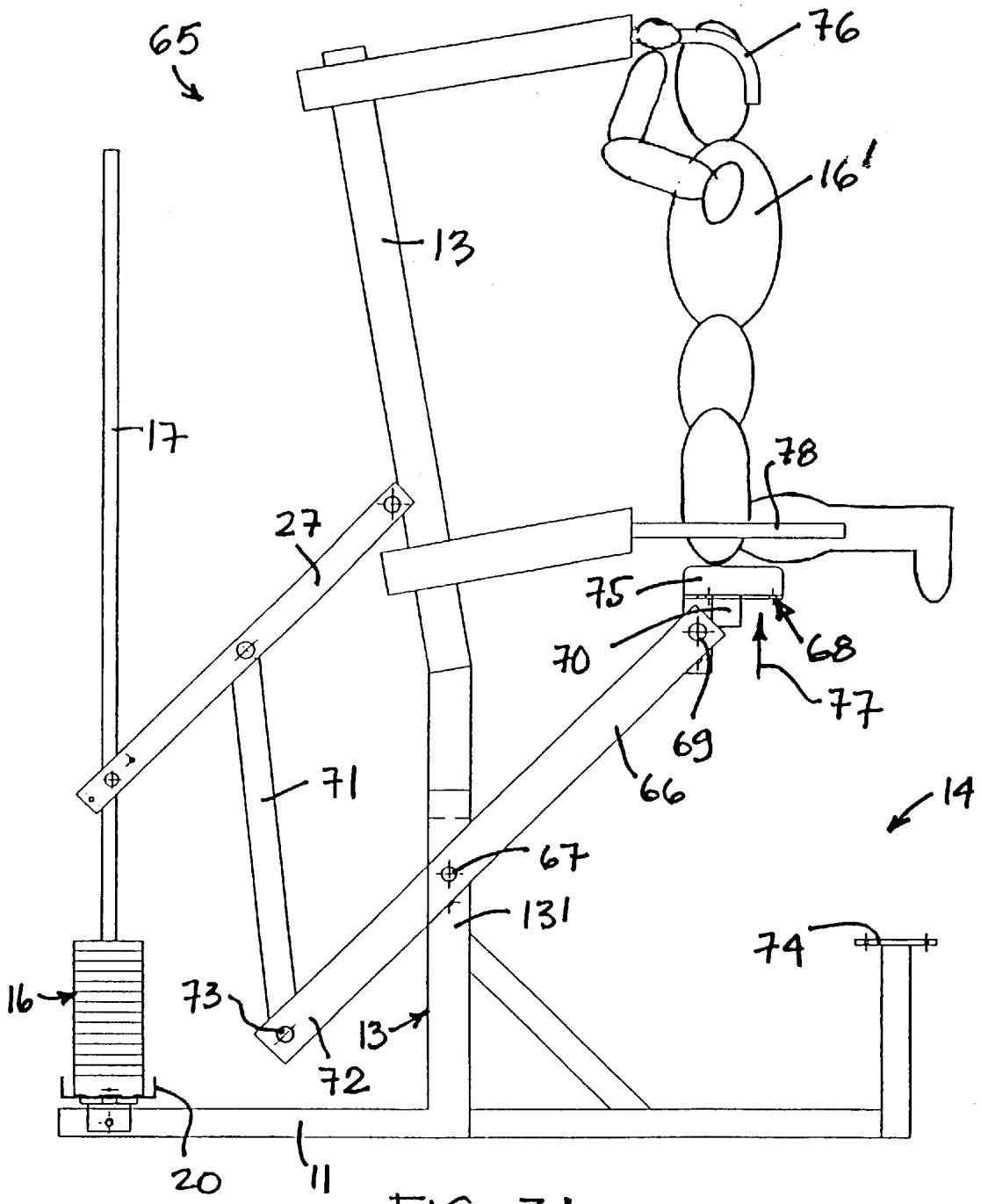
FIG. 3A is a side view of a direct drive chin and dip exercising apparatus constructed in accordance with the present invention showing a user person performing an exercise.
Figure 3B:
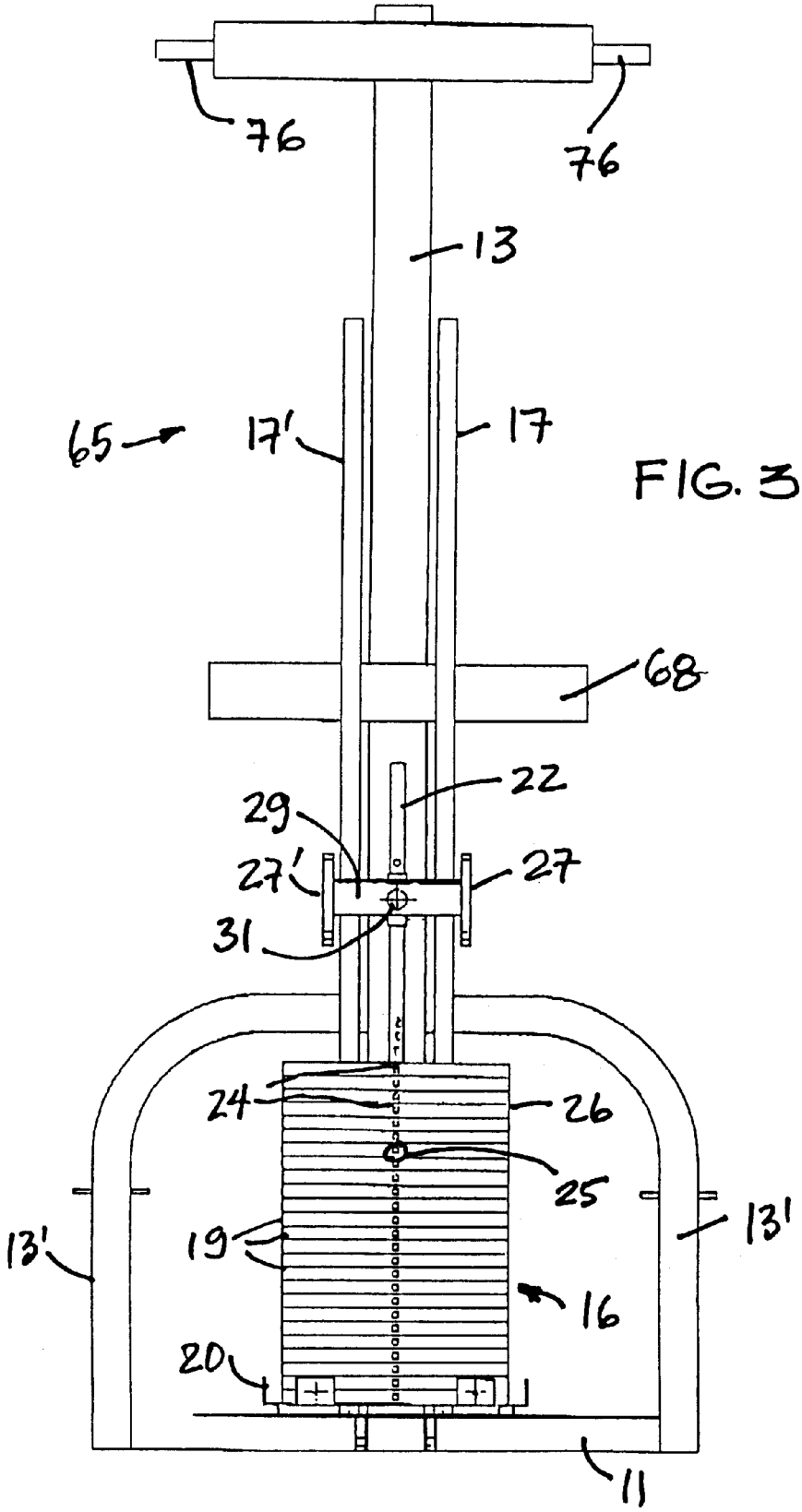
FIG. 3B is a front view of FIG. 3A.

Referring now to FIGS. 3A and 3B there is shown a still further example of the direct drive exercising apparatus and as hereinshown the exercising apparatus 65 is an assisted chin and dip type exercising machine. The force transmitting means is constituted by a pair of straight parallel cantilever arms 66, only one being shown in FIG. 3A. Each of the arms 66 are pivotally connected at an intermediate location by a pivot connection 67 secured a predetermined distance along the vertical post 13' of the attachment frame 13. The user engaging member is herein constituted by a platform 68 which is pivotally connected between the rear end of the cantilever arms 66 by opposed pivot connections 69, only one being shown herein. A platform is supported on the bracket 70 which prevents the platform from pivoting downwardly and it maintains the platform in a substantially horizontal position between the rear ends of the cantilever arms 66. This platform 68 is maintained elevated by the cantilever arm connections.

As hereinshown the link means is provided by a pair of link arms 71 which connects a respective aligned one of the parallel support arms 27 to a free connecting end 72 of an associated one of the cantilever arm 66 by a pivot connection 73. An elevated foot rest 74 is secured to the support frame 11 at the user 16' exercising station 14 to assist the user in climbing onto the platform 68 in a kneeling position as shown by the user person 16' in FIG. 3A. The platform 68 is provided with a knee pad 75 to provide comfort. A pair of handlebars 76 and 76' are secured to a top end of the attachment frame 13 and disposed spaced above the platform 68. This permits the user person 16' to grasp the handlebars to pull upwards on the handlebars 76 while the platform exerts an upward force against the user person thus assisting him in performing his chin exercise by reducing the body weight that the user has to pull upward to perform the chin exercise. Further handlebars 78 may be disposed immediately above the platform 68 for the user to perform another exercise by grabbing the lower handlebar 78 and pushing on the handlebars 78 while the platform exerts an upward force against the user person thus assisting him in performing his chin exercise by reducing the body weight that the user has to pull upward to perform the chin exercise. Thus, the chin and dip exercise is performed.

Figure 4A:
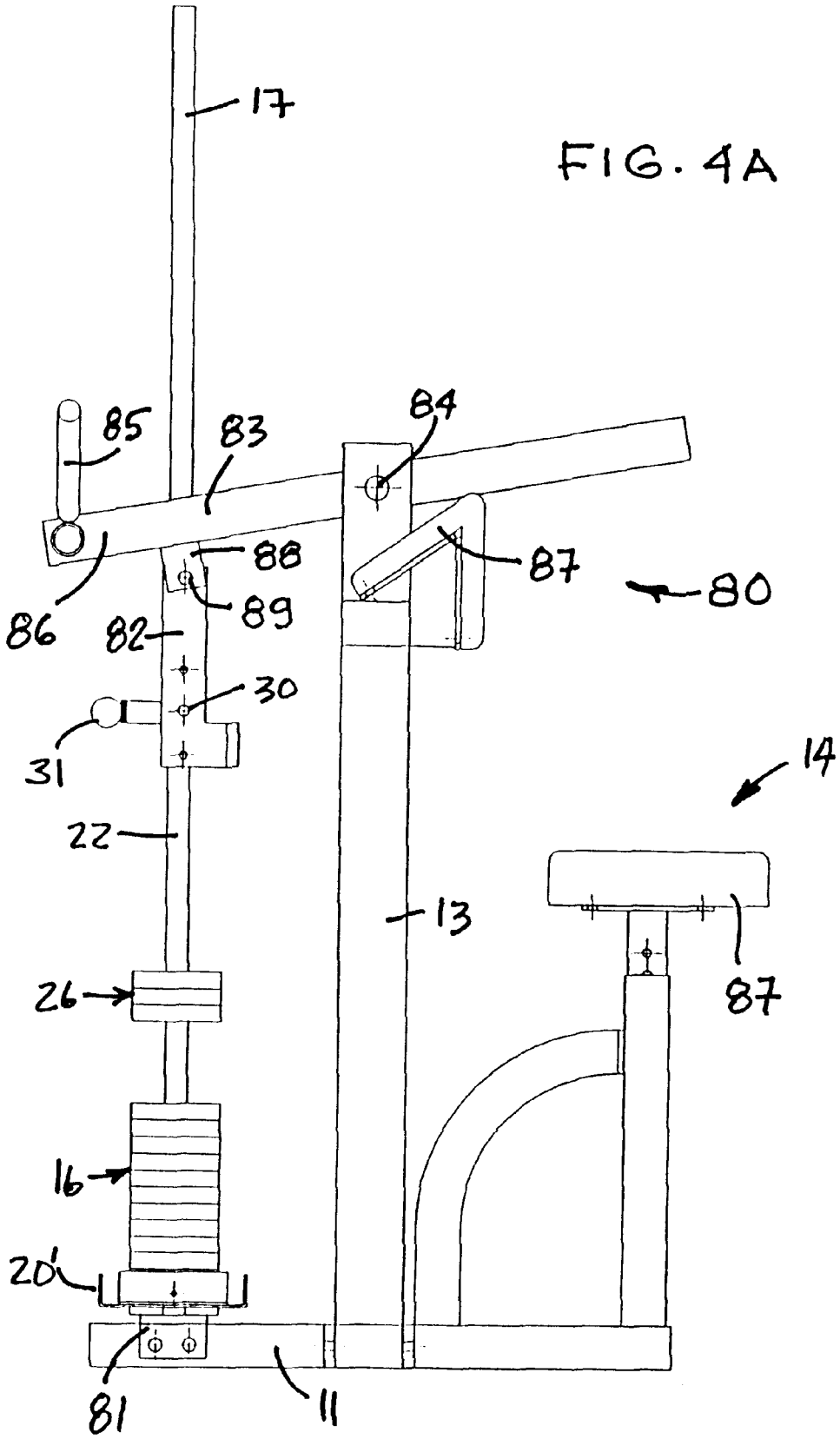
FIG. 4A is a side view of a direct drive arm curl exercising apparatus constructed in accordance with another example of the preferred embodiment of the present invention.
Figure 4B:
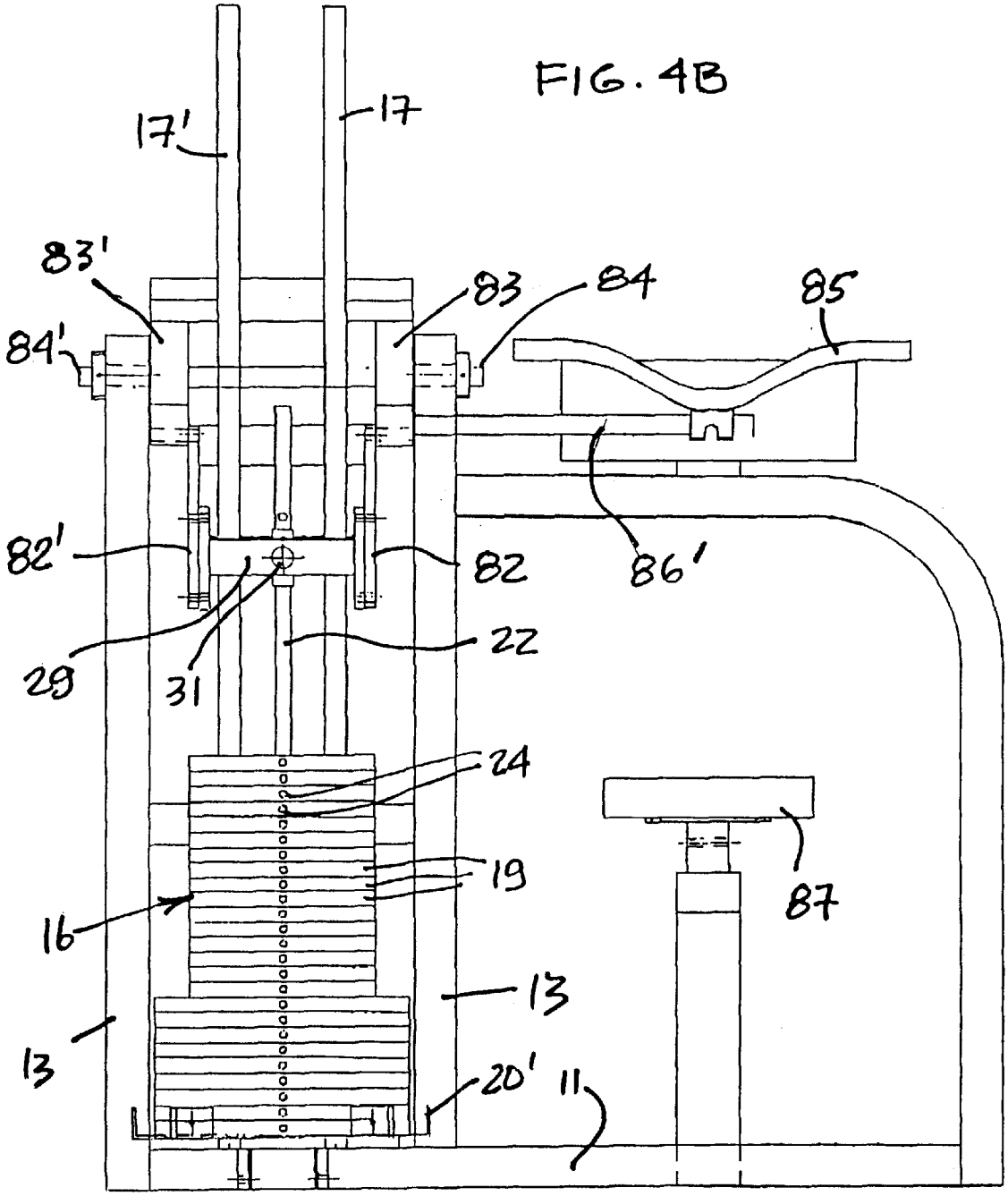
FIG. 4B is a front view of FIG. 4A.
Figure 4C:
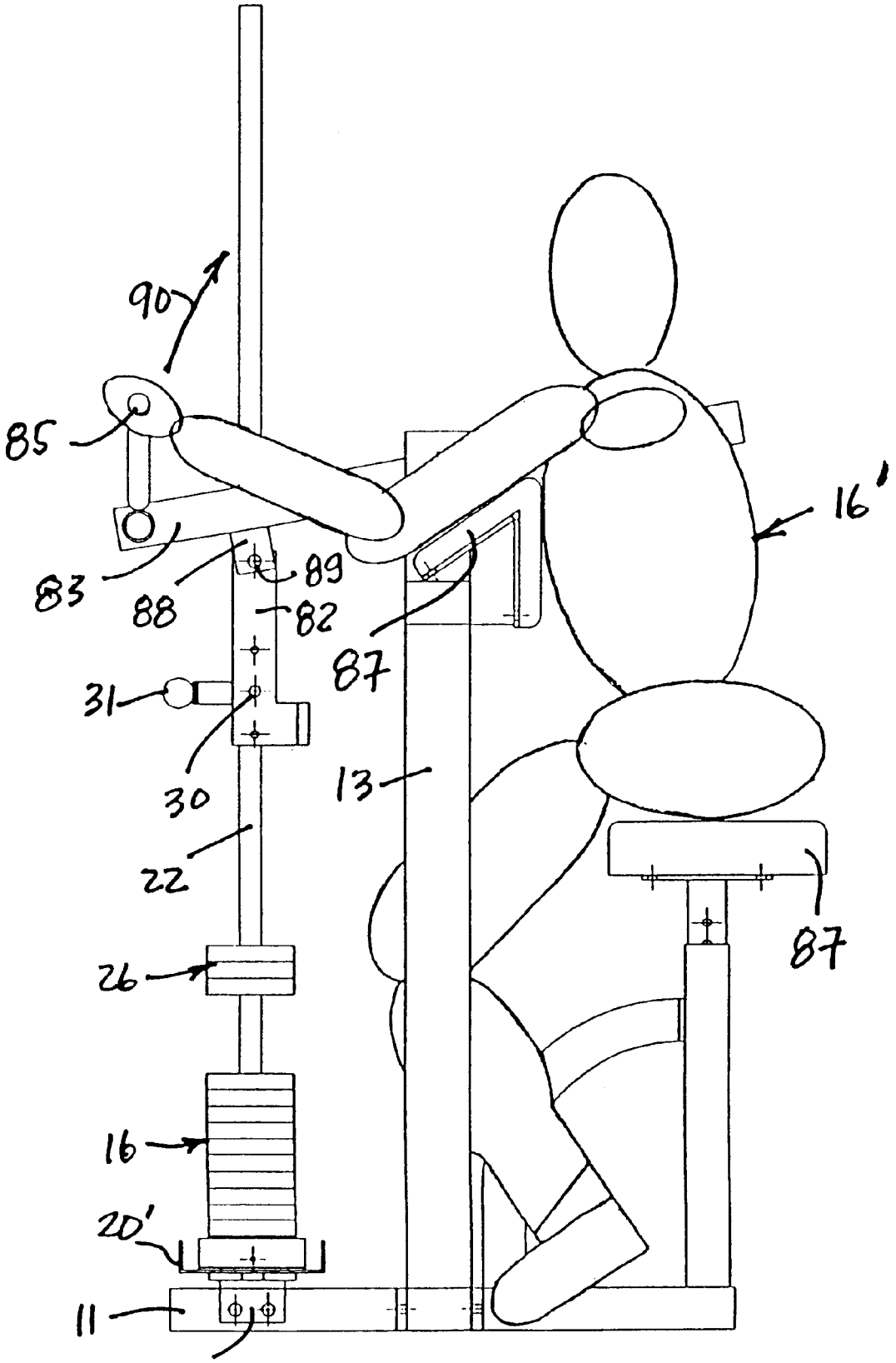
FIG. 4C is a side view similar to FIG. 4A but showing the position of the user person.

Referring now to FIGS. 4A to 4C, there is shown a further embodiment of the arm curl exercising apparatus 80 of the present invention. As hereinshown the weight support harness 20' is immovably connected to the support frame 11 by a bracket 81. Accordingly, the elongated guide rods 17 and 17' and the carrier rod 22 do not pivot and are maintained along a straight fixed vertical axis. The weight stack connecting means is constituted by a pair of straight parallel connecting arms 82 and 82'. The connector block 29 is also pivotally connected to the arms 82 by the pivot connections 30, similar to FIG. 1A.

The force transmitting means in the embodiment of the arm curl exercising apparatus 80 is constituted by a pair of substantially parallel support arms 83, each arm being pivotally connected by a pivot connection 84 to a top end of the attachment frame 13. A user engaging member is provided by a handlebar 85 connected to a forward end 86 of at least one of the support arms 83 in a manner as better illustrated in FIG. 4B where it is shown that the handlebar 85 is connected to the force transmitting arm 83 via a connecting rod 86'. An upper arm rest member 87 is connected to the attachment frame 13 and spaced rearwardly of the handlebar 85. An elevated adjustable seat 87 is also secured to the support frame 11 at the user exercising station 14 whereby the user 16', as shown in FIG. 4C can assume a comfortable position on the exercising machine.

With this particular exercising apparatus the link means is constituted by a pair of link arms 88 which are immovably connected to a respective one of the support arms 83 and pivotally connected at a free end by pivot connections 89 to a top end of a respective one of the connecting arms 82 and 82'.

As shown in FIG. 4C, to perform an arm curl exercise, the user person 16' will grasp the handlebar 85 with his hands and pull the handlebars inwardly towards his face in the direction of arrow 90. By doing so, the arms 83 pivot on pivot connections 84 and 84' and the linkage between the links 88 and the connecting arms 82 will articulate and the arms 82 will pivot on their pivots connections 30. As previously noted, the weight stack and the guide rods are fixed in a vertical plane. The predetermined weight stack 26 will then be lifted and provide a constant weight load to the user during the arm curl movement. As previously described, in order to adjust the height of the handlebar 85, the pin 31 will secure the connector block 29 at the desired height along the carrier member 22.

Figure 5A:
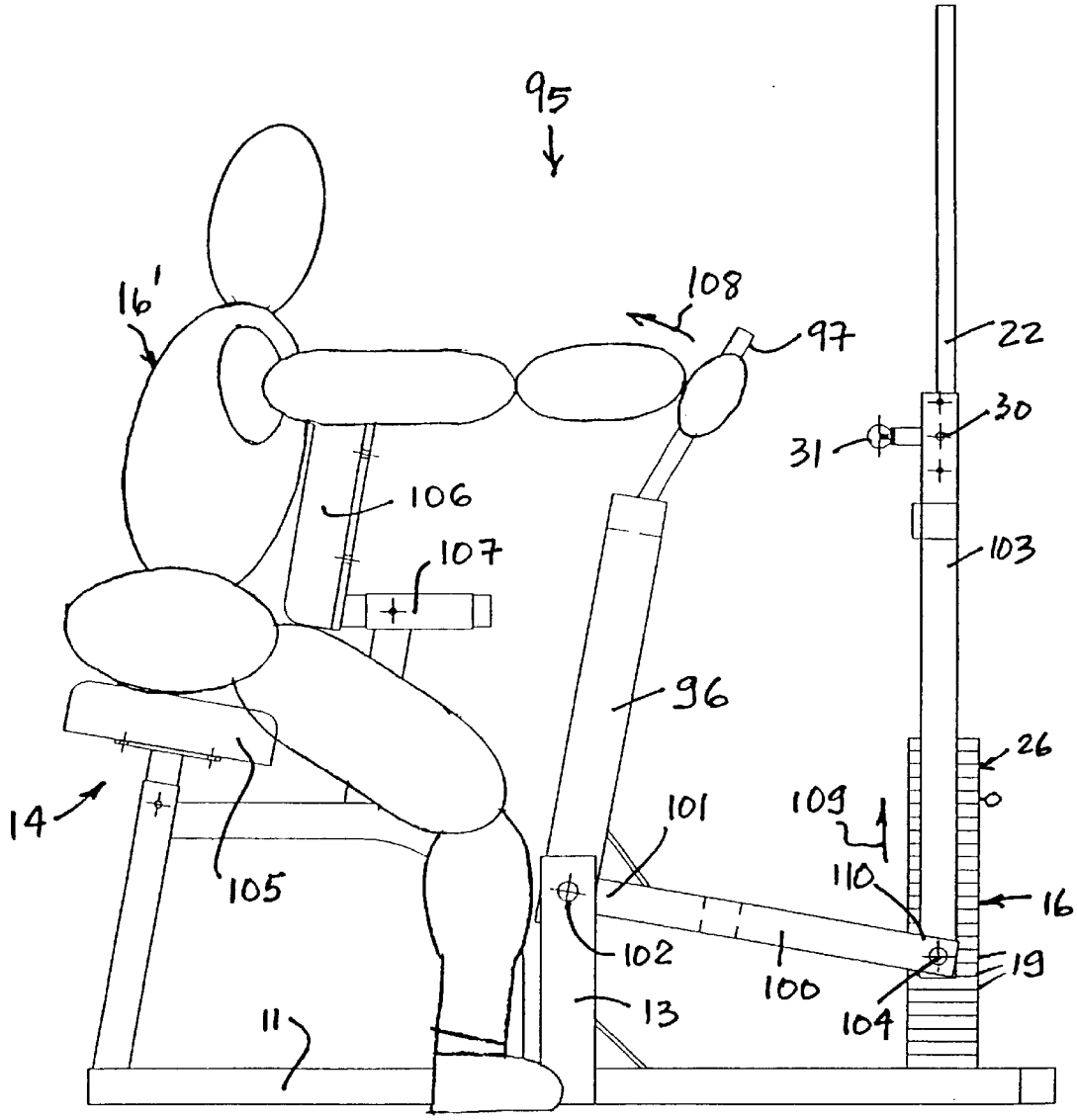
FIG. 5A is a side view of a direct drive rowing exercising apparatus constructed in accordance with the present invention.
Figure 5B:
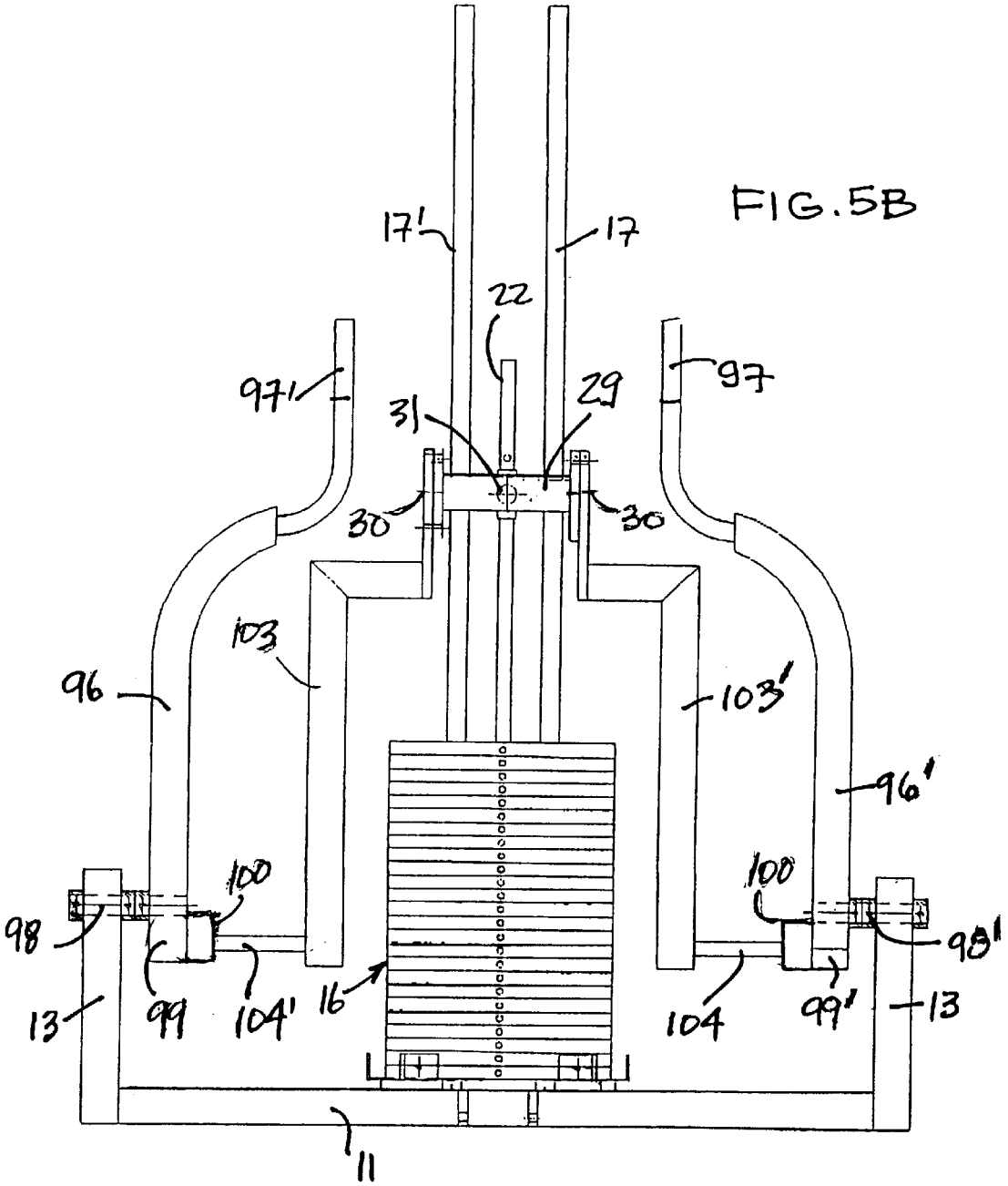
FIG. 5B is a front view of FIG. 5A.

Referring now to FIGS. 5A and 5B, there is shown a still further example of the direct drive exercising apparatus of the present invention. The apparatus 95 is a rowing exercising apparatus. As hereinshown, the force transmitting means is constituted by a pair of substantially parallel upwardly connected rowing arms 96 and 96' each having a handle 97 and 97' at a top free end thereof. The rowing arms 96 and 96' are each pivotally connected by a pivot connection 98 and 98' to the attachment frame 13 and adjacent lower ends 99 and 99' thereof.

The link means of the embodiment of FIGS. 5A and 5B is provided by link arms 100, only one shown herein, and which link arms are immovably secured at one end 101 to a lower free end of the rowing arms 96. The rowing arms 96 are pivotally connected to the attachment frame 13 by a pivot connection 102. A pair of weight stack connecting arms 103 and 103' are secured to the connector block 29 by a pivot connection 30, as previously described, and are interconnected to the link arms 100 by pivot connecting pin 104 and 104'. Again, the weight stack 16 is immovably connected to the support frame 11 and therefore the guide rods 17 and 17', as well as the carrier rod 22, extend upwardly in fixed planes.

An elevated seat 105 is connected to the frame 11 at the user exercising station 14 and a chest rest pad 106 is mounted forwardly of the seat 105. The chest rest pad 106 is adjustably connected by an adjustment mechanism 107 to position the chest rest pad at a desired location forwardly of the seat 105. During the rowing exercise, the user person 16 grasps the handles 97 and 97' and pulls them towards his shoulders in the direction of arrow 108. This causes the link arms 100 to move upwardly in the direction of arrow 109 thus applying an upward movement on the stack connecting arms 103 pulling a predetermined weight stack 26 upwardly. As can be seen, the link arms 100 are pivotally connected at their free ends 110 by the pivot pins 104 and as the link arm move upwardly in the direction of arrow 109 the stack connecting arms 103 will articulate between their opposed pivot connections 104 and 30.

It will be appreciated by those skilled in the art that the concept upon which this disclosure is based, may readily be utilized as a basis for the designing and construction of other exercising structures for carrying out the several purposes of the present invention. The invention is capable of other embodiments and of being practiced and carried out in various ways. Further, it is to be understood that the phraseology and terminology employed herein are for the purpose of description and should not be regarded as limiting. It is important, therefore, that the claims be regarded as including such equivalent constructions insofar as they do not depart from the spirit and scope of the present invention.

What is claimed is:

1. A direct drive rowing exercising apparatus comprising a support frame for supporting said apparatus on a floor surface, an attachment frame secured to said support frame and extending above said support frame, a user exercising station is disposed relative to said attachment frame, a weight stack is slidingly retained on an elongated guide restraining means, said guide restraining means being fixed at a lower end thereof, said weight stack having a plurality of weight elements of predetermined weight, each of said weight elements having means to connect same at a desired location along an elongated carrier member, a connector to secure a weight element to said carrier member at said desired location, a pair of weight stack connecting arms are pivotally connected at an upper end to opposite sides of said carrier member and pivotally connected at a lower end to an intermediate link arm, said intermediate link arm being secured to a force transmitting means which is secured to said attachment frame by a pivot connection, a user engaging member secured to said force transmitting means to impart pivotal movement thereto on said pivot connection, said force transmitting means when drawn towards said exercising station causing said intermediate link arms to apply an upward force on said stack connecting means to lift a stack of selected ones of said weight elements in a guided manner along said elongated guide restraining means.

2. A direct drive rowing exercising apparatus as claimed in claim 1 wherein said weight stack connecting arms are constituted by a pair of straight parallel connecting arms and a connector block pivotally secured between said arms by opposed pivot connections, said connector block being secured to said carrier member, said elongated guide restraining means extending through guide bore means in said connector block.

3. A direct drive rowing exercising apparatus as claimed in claim 2 wherein said elongated guide restraining means is a pair of guide rods, each of said weight elements having a pair of through bores for receiving said pair of guide rods therethrough, said guide bore means being a pair of through bores provided in said connector block.

4. A direct drive rowing exercising apparatus as claimed in claim 2 wherein said force transmitting means is constituted by a pair of substantially parallel vertically disposed rowing arms, each of said rowing arms having a handle at a top end thereof and pivotally connected to said attachment frame adjacent a lower end thereof by a pivot connection.

5. A direct drive rowing exercising apparatus as claimed in claim 4 wherein there is provided an elevated seat connected to said support frame to one side of said rowing arms and centrally disposed between said rowing arms, a chest rest member secured at a predetermined position between said seat and said rowing arms.

6. A direct drive rowing exercising apparatus as claimed in claim 5 wherein said link arms are constituted by a pair of link arms, said link arms being immovably secured at one end to a lower free end of said rowing arms and pivotally connected at an opposed end to a lower end of a respective one of said straight parallel connecting arms, said handles when drawn towards said seat by a user imparting an upwardly force on said straight parallel connecting arms to lift a stack of a predetermined number of weight elements.

7. A direct drive rowing exercising apparatus as claimed in claim 1 wherein said elongated guide restraining means is constituted by a pair of straight substantially parallel guide rods extending through holes provided in said weight elements, said means to connect said weight elements to said elongated carrier member being comprised by a transverse hole extending centrally from a side edge of each of said weight elements and extending to a central hole thereof and through which said elongated carrier member extends, said elongated carrier member being a rod having a plurality of equidistantly spaced holes therein whereby to receive said connector element when positioned through said transverse hole of said selected one of said weight elements.

* * * * *